US009016403B2

(12) United States Patent
Aros

(10) Patent No.: US 9,016,403 B2
(45) Date of Patent: Apr. 28, 2015

(54) PRESSURIZED FLUID FLOW SYSTEM HAVING MULTIPLE WORK CHAMBERS FOR A DOWN-THE-HOLE DRILL HAMMER AND NORMAL AND REVERSE CIRCULATION HAMMERS THEREOF

(75) Inventor: Jaime Andrés Aros, Santiago (CL)

(73) Assignee: Drillco Tools S.A., Quilicura, Santiago (CL)

( * ) Notice: Subject to any disclaimer, the term of this patent is extended or adjusted under 35 U.S.C. 154(b) by 417 days.

(21) Appl. No.: 13/617,430

(22) Filed: Sep. 14, 2012

(65) Prior Publication Data

US 2014/0076638 A1 Mar. 20, 2014

(51) Int. Cl.
*E21B 4/14* (2006.01)

(52) U.S. Cl.
CPC ..... *E21B 4/14* (2013.01)

(58) Field of Classification Search
CPC ..... E21B 4/14; E21B 4/145; E21B 1/00
USPC ..... 175/296, 297
See application file for complete search history.

(56) References Cited

U.S. PATENT DOCUMENTS 4,923,018 A * 5/1990 Meek ..... 173/78
5,131,476 A * 7/1992 Harrington ..... 173/17
5,396,965 A * 3/1995 Hall et al. ..... 173/73
5,685,380 A * 11/1997 Purcell et al. ..... 175/215
6,386,301 B1 * 5/2002 Rear ..... 175/296
6,883,618 B1 * 4/2005 Pascale ..... 173/91
2002/0014354 A1 * 2/2002 Patterson ..... 175/57
2002/0066599 A1 * 6/2002 Gien ..... 175/92
2005/0126822 A1 * 6/2005 Campbell et al. ..... 175/57
2006/0000646 A1 * 1/2006 Purcell ..... 175/296
2007/0102196 A1 * 5/2007 Bassinger ..... 175/296
2007/0261869 A1 * 11/2007 In ..... 173/13
2008/0156540 A1 * 7/2008 Beccu ..... 175/296
2009/0188723 A1 * 7/2009 Aros ..... 175/296
2011/0209919 A1 * 9/2011 Aros ..... 175/296
2013/0233626 A1 * 9/2013 Aros ..... 175/296

* cited by examiner

*Primary Examiner* — Blake Michener
(74) *Attorney, Agent, or Firm* — Ladas & Parry LLP

(57) ABSTRACT

A pressurized fluid flow system for a down the hole drill hammer has a plurality of chambers that exert work, namely one or more auxiliary drive and lifting chambers besides two main chambers located at opposite ends of the piston, the auxiliary chambers each formed around respective waists on the piston and externally delimited by respective cylinders which are arranged longitudinally in series. Two or more internal chambers filled with the pressurized fluid are defined by recesses in the inner surfaces of the piston for supplying said fluid to the work chambers, controlled in a cooperative way by the piston and a control tube coaxially arranged within a central bore of the piston. One or more discharge chambers are formed in between the outer casing and the cylinders for emptying the work chambers through discharge ports in the cylinders. Reverse and normal circulation drill hammers are provided having this system.

7 Claims, 4 Drawing Sheets

PRESSURIZED FLUID FLOW SYSTEM HAVING MULTIPLE WORK CHAMBERS FOR A DOWN-THE-HOLE DRILL HAMMER AND NORMAL AND REVERSE CIRCULATION HAMMERS THEREOF

STATE OF THE ART

There are many different down the hole (DTH) drill hammers available for drilling and sample recovery in mining, civil works and in the construction of water, oil&gas and geothermal wells. These hammers are powered by pressurized fluid that is alternatively directed by different means, depending on the design of the drill hammer and type of hammer (normal circulation drill hammers are for production while reverse circulation drill hammers are for sample recovery), into a lifting chamber and a drive chamber, which are located at opposite ends of the hammer piston. As one chamber is being filled with pressurized fluid, the other is being emptied and the difference in pressure between the lifting and drive chambers causes the reciprocating movement of the piston and the impact of the same on the drill bit with each working stroke of the piston.

Most of the known DTH drill hammers have only one drive chamber and one lifting chamber. In such cases, the piston has only one drive area and one lifting area. However, for increasing the effective thrust areas (i.e. drive area and lifting area) a number of DTH drill hammers make use of more than two chambers for moving the piston, two of which examples are described below.

U.S. Pat. No. 5,915,483

The normal circulation drill hammer design described in this patent has a centrally-bored piston shaped to provide an additional drive chamber and an additional lifting chamber between the piston and the inner wall of the outer casing of the hammer. These two additional chambers are created by recesses on the outer diameter of the piston and separated by a partition member.

For controlling the flow of pressurized fluid in and out of the chambers, a control rod is provided that extends from the backhead or rear sub of the hammer axially down the central bore of the piston, the control rod having one longitudinally extending supply passage and one longitudinally extending discharge passage. Ports in the control rod and piston respectively connect these passages with the lifting and drive chambers when the ports in the control rod are aligned with the ports in the piston during the reciprocating movement of the latter.

The main drive chamber is continuously connected to the source of pressurized fluid and from there the pressurized fluid is conveyed to the longitudinal supply passage of the control rod for alternately supplying the additional lifting and drive chambers with pressurized fluid, controlled by the relative position of the piston with the control rod.

The discharge of pressurized fluid from the main lifting chamber is controlled by the relative position between the piston and either a foot valve or an extended control rod, while the discharge from the additional lifting and drive chambers is controlled by the relative position of the piston and the control rod.

One disadvantage of this design is that the pressure in the main drive chamber is equal in average to the supply pressure of the working fluid, which means that the work exerted by the pressurized fluid over this region of the piston is null, so that the power of the hammer is negatively affected. Another disadvantage is the cross-sectional area occupied by the control rod, resulting in reduced front and rear thrust areas.

U.S. Pat. No. 5,992,545

This patent describes a normal circulation drill hammer design where the piston comprises a forward piston head, a rearward piston head provided with a main drive area, and a waist between the piston heads. An intermediate wall is arranged around the waist of the piston so that two chambers are formed on each side of the intermediate wall between the piston's waist and front and rear linings disposed in the housing of the hammer. A pin is arranged through the intermediate wall in order to lock the linings in fixed angular positions relative to the intermediate wall.

In between the front and rear linings and the housing there are disposed respective channels. The first of these channels is connected through radial holes in the rear lining with a room rearward of the piston which is continuously connected to the source of pressurized fluid. The second of these channels is connected with a space in the front end of the piston where the forward piston head is located and a main lifting area is defined.

The chamber formed between the forward piston head and the intermediate wall is continuously connected with the channel between the rear lining and the housing via a first channel in the intermediate wall and holes in the rear lining, thus said chamber being continuously filled with pressurized fluid from the source of such fluid. The chamber between the rearward piston head and the intermediate wall is connected via a second channel in the intermediate wall to the channel between the front lining and the housing and therefrom with the space in the front end of the piston.

The supply of pressurized fluid to the room where the main drive area is located, inside the rearward piston head, is controlled by a valve part arranged on a tube that is connected to the hammer string, said tube having holes open to the room. The discharge of said room is controlled by the overlap of the inner surface of the piston with radial holes in said tube, said radial holes conveying the pressurized fluid through the a central channel in the piston to a flushing hole of the drill bit. A foot valve is used for controlling the discharge of the space in the front end of the piston.

The supply of pressurized fluid to the space in the front end of the piston is controlled by the relative position of the outer surface of the piston and the inner surface of the front lining.

Since in this design the chamber formed between the forward piston head and the intermediate wall is continuously connected to the source of pressurized fluid, work exerted by this region of the piston is null.

OBJECTIVES OF THE INVENTION

The DTH drill hammers of the prior art described above have the drawback that they do not make use of the whole capacity of the additional drive and lifting chambers provided because at least one of these chambers is continuously connected to the source of pressurized fluid so the work exerted by the chamber is null.

Therefore, due to the high costs of operating drilling equipment and the greater depths of the wells needed in some applications such as oil&gas and minerals exploration, it would be desirable to have a pressurized fluid flow system for a DTH drill hammer that could incorporate the following improvements without affecting the useful life of the hammer:

- a greater pressurized fluid consumption and as a result a higher power and a greater penetration rate,
- a higher efficiency in the energy conversion process to provide an even higher power and even greater penetration rate, and increased drilling capacity at greater depths It would also be desirable that, in terms of control of the state of the lifting and drive chambers, the pressurized fluid flow system of the invention could have application in both normal circulation DTH drill hammers and reverse circulation DTH drill hammers.

SUMMARY OF THE INVENTION

In a first aspect of the invention an improved pressurized fluid flow system for a down the hole drill hammer is provided, characterized by the presence of a plurality of chambers that exert work on the piston, namely, one or more auxiliary drive chambers and one or more auxiliary lifting chambers besides two main chambers located at opposite ends of the piston. These auxiliary chambers are each formed around respective waists machined around the piston and are externally delimited by respective cylinders. The cylinders are arranged longitudinally in series and coaxially disposed in between the outer casing of the hammer and the piston, the cylinders being separated from each other by seals and supported on the outer casing.

The pressurized fluid flow system of the invention is further characterized by having two or more internal chambers, including at least one forwardmost internal chamber and one rearmost internal chamber defined by recesses in the inner surfaces of the piston, all the internal chambers being in fluid communication with the source of pressurized fluid and permanently filled with the same, for supplying the multiple drive and lifting chambers with said fluid.

The supply of pressurized fluid into said chambers is controlled in the invention in a cooperative way by the piston and a control tube, wherein the control tube is coaxially disposed within the central bore of the piston, adjacent to the piston and affixed by its rear end to the rear sub. A set of inlet ports are provided in the rear end of the control tube to enable the pressurized fluid coming from said source of pressurized fluid to pass to the inside of the control tube and to flow from there into the internal chambers through a set of supply ports bored in the control tube. Sealing means are provided at the front end of the control tube to prevent any pressurized fluid from flowing out through said end of the control tube and instead only permitting the pressurized fluid to flow out through said supply ports of the control tube.

In the invention, the piston has a set of feeding ports for conveying pressurized fluid from the internal chambers to the auxiliary lifting and drive chambers, the main lifting chamber and drive chamber being in turn fed with pressurized fluid through respective feeding passageways defined between the inner surfaces of the piston and recessed outer surfaces of the control tube at each end thereof.

The pressurized fluid flow system of the invention is also characterized by having one or more discharge chambers formed in between the outer casing and the cylinders, the discharge chambers being in fluid communication with the bottom of the hole drilled by the hammer for discharging pressurized fluid from the multiple drive and lifting chambers. For this purpose, a set of discharge ports are provided in the cylinders, for connecting the drive and lifting chambers with the discharge chambers. In this manner, the discharge of pressurized fluid from the drive and lifting chambers is controlled in a cooperative way by the piston and the cylinders, specifically by the outer sliding surfaces of the piston and the inner surfaces of the cylinders.

In a second aspect of the invention, a reverse circulation DTH drill hammer is provided, characterized in that it comprises the improved pressurized fluid flow system herein described and one or more end discharge ports bored through the outer casing, the ports connected to the discharge chambers and in register with respective longitudinal discharge channels formed in the outer surface of the outer casing, wherein both the ports and channels are covered by an outer sealing sleeve, so as to direct the pressurized fluid to the peripheral region of the front end of the drill bit. The reverse circulation DTH drill hammer comprises, as such, a sample tube coaxially disposed within the outer casing and extending from the rear sub to the drill bit. The control tube in this case is specifically disposed in between the piston and the sample tube, with a gap in between the control tube and the sample tube that defines an annular passageway for the pressurized fluid.

In a third aspect of the invention, a normal circulation DTH drill hammer is provided that is characterized by comprising the improved pressurized fluid flow system herein described and a drill bit guide with one or more apertures that connect the discharge chambers with channels formed between the splines of the drill bit, the drill bit having flushing holes which connect these channels between the splines of the drill bit with the bottom of the hole.

To facilitate the understanding of the precedent ideas, the invention is hereinafter described making reference to the attached drawings.

Figure 1:
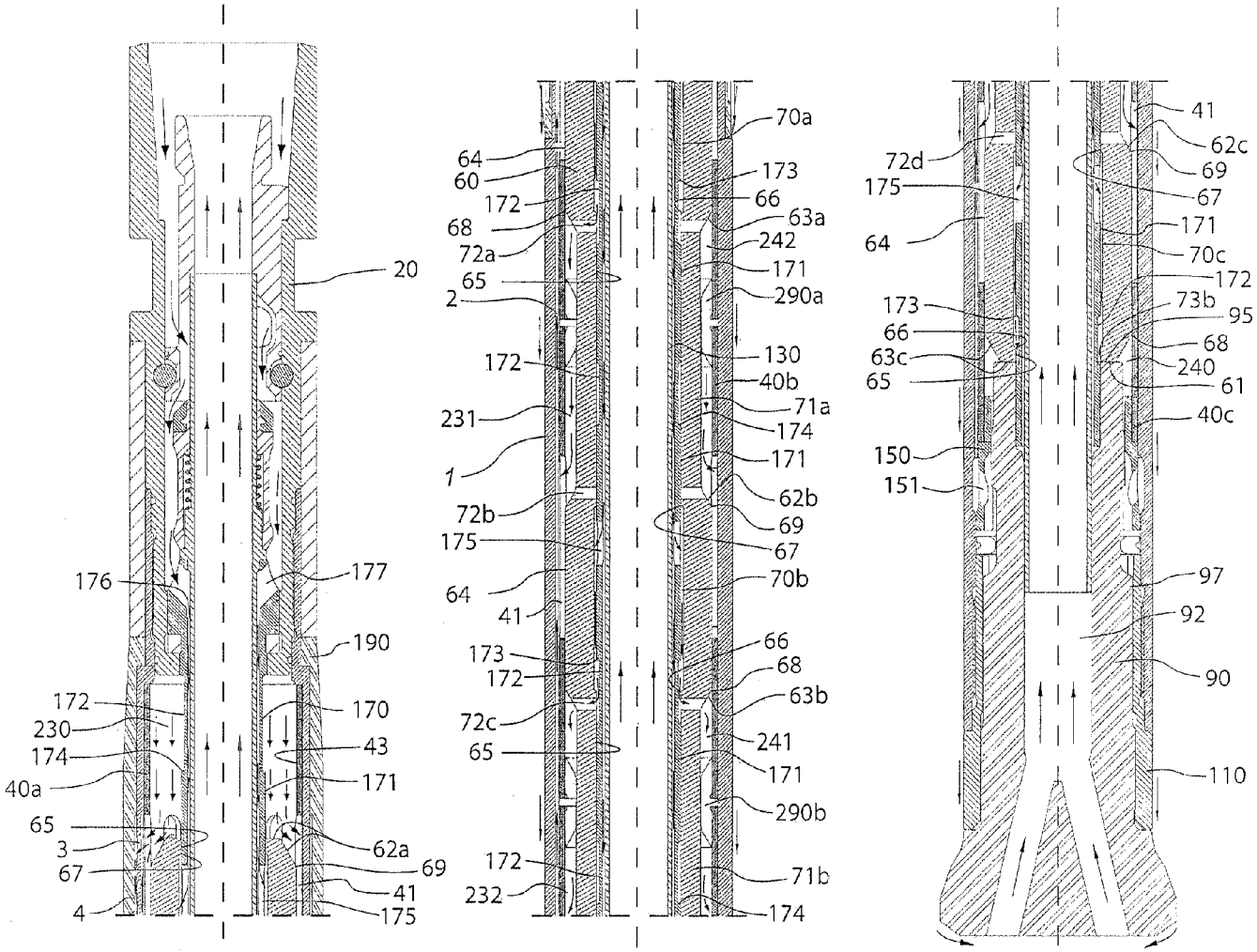
FIG. 1 depicts a longitudinal cross section view of a reverse circulation DTH drill hammer according to the invention, the hammer comprising the improved pressurized fluid flow system of the invention, specifically showing the disposition of the piston with respect to the cylinders and seals, drill bit and control tube when the plurality of lifting chambers are being supplied with pressurized fluid and the plurality of drive chambers are discharging pressurized fluid to the bottom of the hole.
Figure 2:
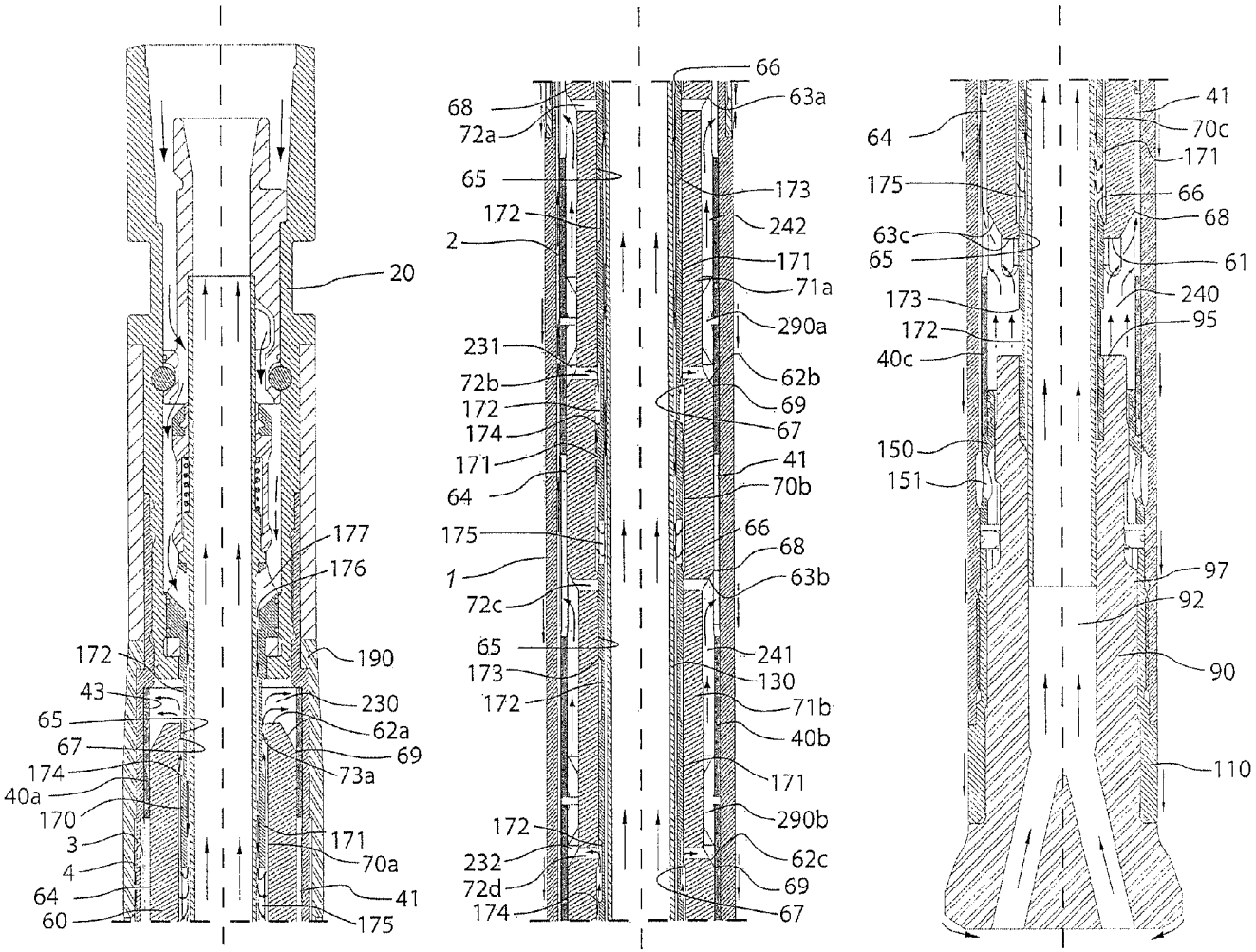
FIG. 2 depicts a longitudinal cross section view of a reverse circulation DTH drill hammer according to the invention, the hammer comprising the improved pressurized fluid flow system of the invention, specifically showing the disposition of the piston with respect to the cylinders and seals, drill bit and control tube when the plurality of drive chambers are being supplied with pressurized fluid and the plurality of lifting chambers are discharging pressurized fluid to the bottom of the hole.
Figure 3:
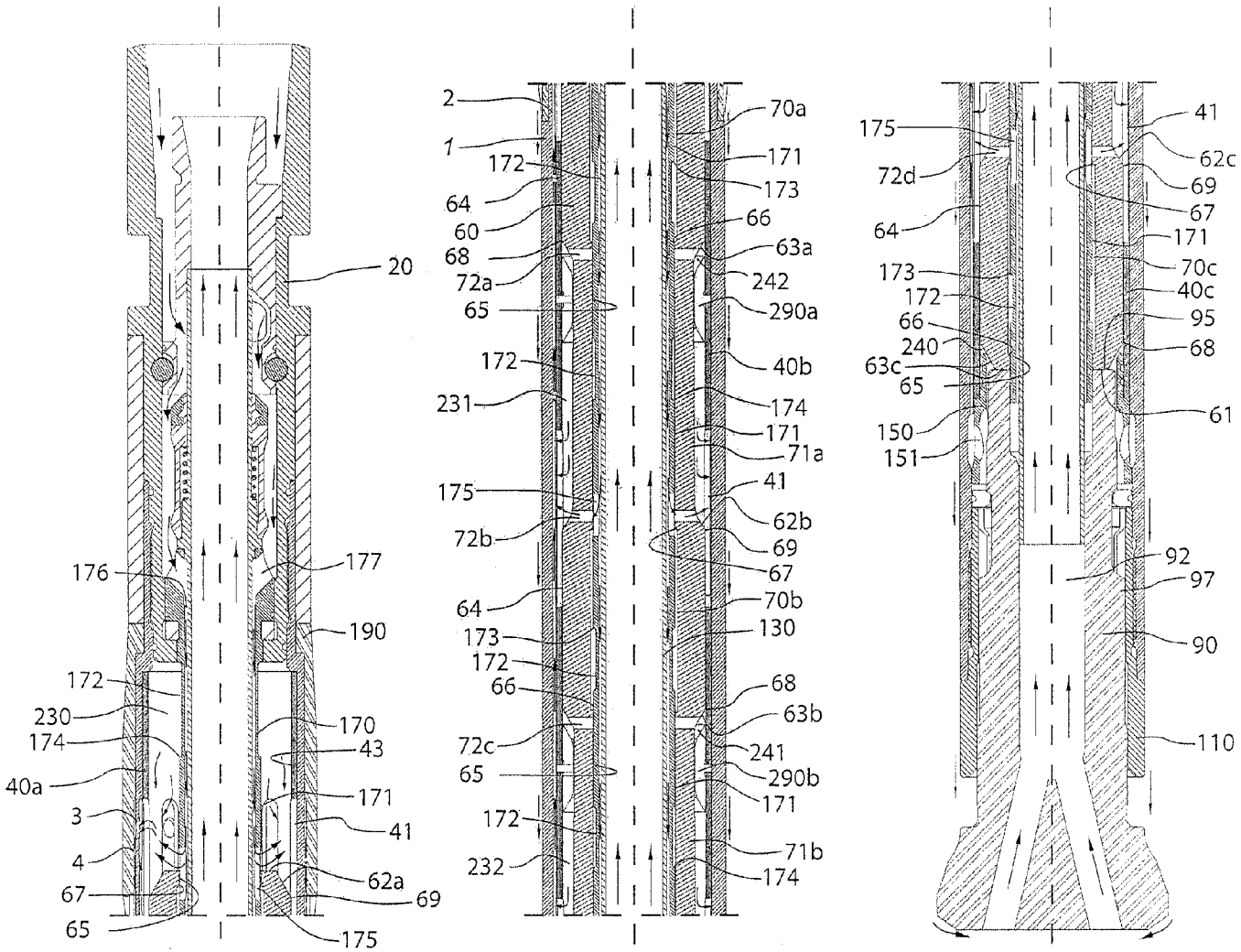
FIG. 3 depicts a longitudinal cross section view of the reverse circulation DTH drill hammer according to the invention, the hammer comprising the improved pressurized fluid flow system of the invention, specifically showing the disposition of the piston with respect to the cylinders and seals, drill bit and control tube when the hammer is in flushing mode.

The pressurized fluid flow system of the invention has been depicted in FIGS. 1, 2 and 3, as applied to a reverse circulation DTH drill hammer, showing the solution designed under the invention to convey the pressurized fluid to the plurality of lifting chambers and drive chambers, and from these chambers to the discharge chambers and therefrom to the bottom of the hole drilled by the hammer, in all modes and states of these chambers, including the exhaust of pressurized fluid to the peripheral region of the front end of the drill bit for flushing the rock cuttings. The direction of the pressurized fluid flow has been indicated by means of arrows.

Figure 4:
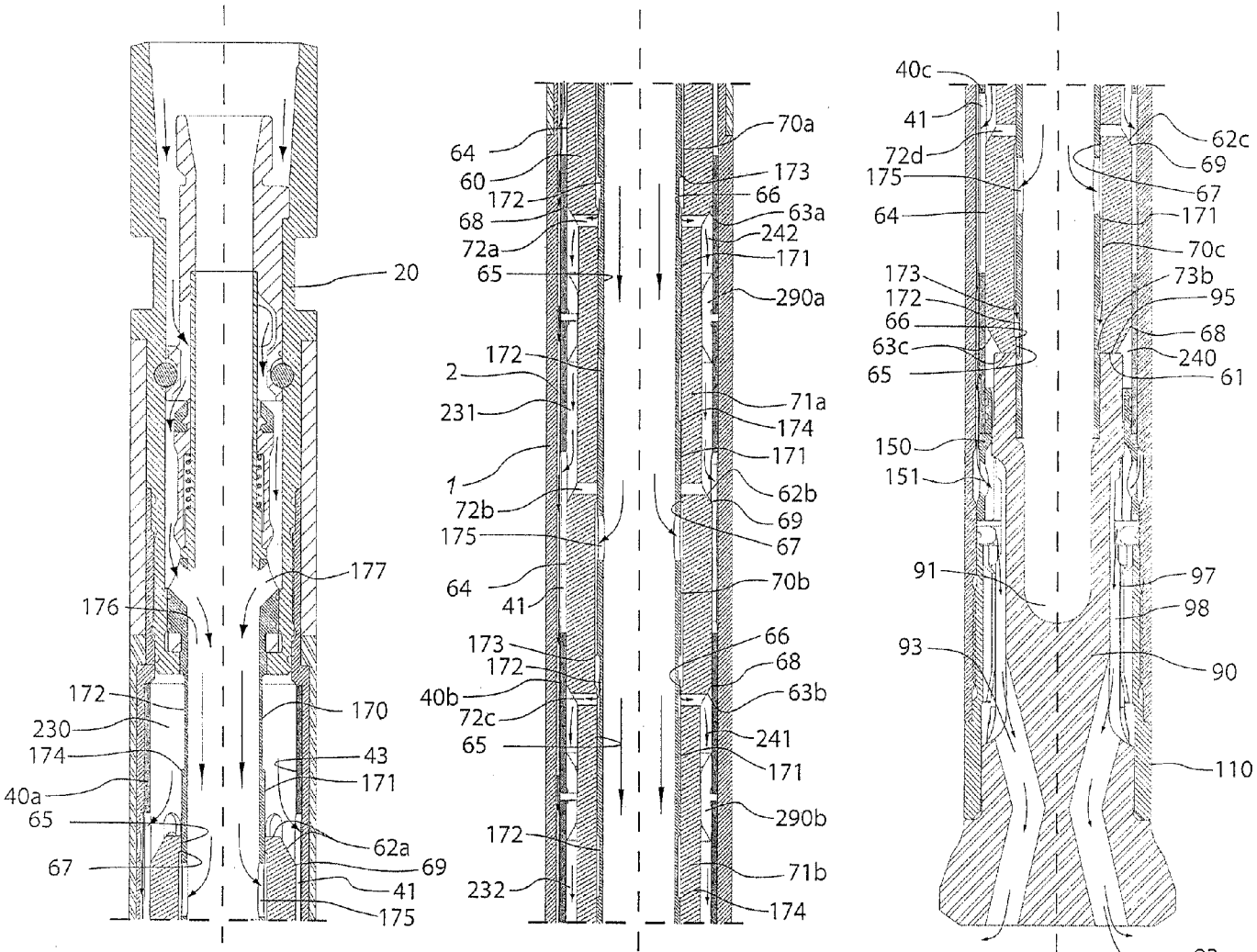
FIG. 4 depicts a longitudinal cross section view of a normal circulation DTH drill hammer according to the invention, the hammer having the improved pressurized fluid flow system of the invention, specifically showing the disposition of the piston with respect to the cylinders and seals, drill bit and control tube when the plurality of lifting chambers are being supplied with pressurized fluid and the plurality of drive chambers are discharging pressurized fluid to the bottom of the hole.

On the other hand, FIG. 4, that applies to a normal circulation DTH drill hammer according to the invention, only shows the state where the plurality of lifting chambers are being supplied with pressurized fluid and the plurality of drive chambers are discharging pressurized fluid to the bottom of the hole. However, a skilled person in the art will readily visualize the rest of the states that the plurality of lifting and drive chambers of a normal circulation DTH hammer undergoes during the drilling operation, since the pressurized fluid flow system is the same than that depicted for a reverse circulation DTH hammer in FIGS. 1 to 3.

DETAILED DESCRIPTION OF A FIRST PREFERRED EMBODIMENT OF THE INVENTION (FIGS. 1 to 3)

Referring to FIGS. 1 to 3, the pressurized fluid flow system according to a first preferred embodiment of the invention comprises the following main components:

a cylindrical outer casing (1);

a rear sub (20) affixed to the rear end of said outer casing (1) for connecting the hammer to a source of pressurized fluid;

a centrally-bored piston (60) which is slidably and coaxially disposed to excert a reciprocating movement inside the outer casing (1);

a drill bit (90) which has a central bore (92) and is slidably mounted on a driver sub (110) in the front end of the hammer, wherein the drill bit (90) is aligned with the outer casing (1) by means of a drill bit guide (150) disposed inside said outer casing (1); and a sample tube (130) coaxially disposed within the outer casing (1) and extending from the rear sub (20) to the drill bit (90), the sample tube being inserted at its front end in the central bore (92) of the drill bit (90).

As shown in these figures, the pressurized fluid flow system of the invention further comprises the following components:

a main lifting chamber (240) and a main drive chamber (230) located at opposites ends of the piston (60) for causing the reciprocating movement of the piston (60) due to the changes in pressure of the pressurized fluid contained therein;

a set of cylinders (40*a*, 40*b*, 40*c*), in this case three cylinders, that are arranged longitudinally in series and are coaxially disposed between the outer casing (1) and the piston (60), the cylinders (40*a*, 40*b*, 40*c*) being supported on the outer casing (1) and separated from each other by seals (290*a*, 290*b*);

a set of auxiliary lifting chambers (241, 242) and auxiliary drive chambers (231, 232), in this case two of each, respectively located at each side of said seals (290*a*, 290*b*) and respectively formed by rear (71*a*) and front (71*b*) waists machined around the piston (60), for likewise causing the reciprocating movement of the piston (60) in conjunction with the main lifting and drive chambers (240, 230), due to the changes in pressure of the pressurized fluid contained therein;

a control tube (170) coaxially arranged in between the piston (60) and the sample tube (130), the control tube (170) affixed by its rear end to the rear sub (20) and disposed adjacent the piston (60) with a gap with the sample tube (130) that defines an annular passageway (176);

a set of internal chambers (70*a*, 70*b*, 70*c*) defined by recesses in the inner surfaces (65) of the piston (60), the internal chambers (70*a*, 70*b*, 70*c*) being in permanent fluid communication with the source of pressurized fluid and filled with the same; and one or more discharge chambers (2) formed in between the outer casing (1) and the cylinders (40*a*, 40*b*, 40*c*) by a set of recesses in the inner surface of the outer casing (1), the recesses facing the cylinders (40*a*, 40*b*, 40*c*), the discharge chambers (2) being in permanent fluid communication with the bottom of the hole.

As can be noted, the control tube (170) has portions with recessed outer surfaces (172). Also, the control tube (170) has pressurized fluid inlet ports (177) bored at its rear end that connect the annular passageway (176) with the source of pressurized fluid. Further, the control tube (170) has a set of supply ports (175) bored forward of said inlet ports (177) that allow the pressurized fluid to flow from the source of pressurized fluid into the internal chambers (70*a*, 70*b*, 70*c*) through the annular passageway (176). Further still, the control tube (170) has pressurized fluid sealing means at its front end.

In the case of the preferred embodiment of the invention depicted in FIGS. 1 to 3, the control tube (170) extends into the central bore (92) of the drill bit (90) and the sealing means are specifically defined by an internal shoulder in the central bore (92) of the drill bit (90). However, in other embodiments of the invention the control tube (170) may not extend into the central bore (92) of the drill bit (90), in which case the sealing means may comprise an end flange of the control tube (170) itself.

The piston (60) comprises a set of lifting chamber feeding ports (72*a*, 72*c*), and a set of drive chamber feeding ports (72*b*, 72*d*) bored therethrough for respectively conveying pressurized fluid from the internal chambers (70*a*, 70*b*, 70*c*) to the auxiliary lifting chambers (241, 242) and to the auxiliary drive chambers (231, 232).

A rear feeding passageway (73*a*) and a front feeding passageway (73*b*) are respectively formed at each end of the piston (60), between the inner surfaces (65) of the piston (60) and recessed outer surfaces (172) of the control tube (170), for respectively conveying pressurized fluid from the forwardmost internal chamber (70*c*) to the main lifting chamber (240) and from the rearmost internal chamber (70*a*) to the main drive chamber (230).

The cylinders (40*a*, 40*b*, 40*c*) have a set of discharge ports (41) bored therethrough for discharging pressurized fluid from the lifting chambers (240, 241, 242) and drive chambers (230, 231, 232) to the discharge chambers (2).

The precise boundaries of the different drive and lifting chambers are as follows:

The main drive chamber (230) of the hammer is defined by the rear sub (20), the rear cylinder (40*a*), the control tube (170) and the main drive surface (62*a*) of the piston (60).

The first auxiliary drive chamber (231) is defined by the rear seal (290*a*), the middle cylinder (40*b*), the piston's rear waist (71*a*) and the first auxiliary drive surface (62*b*) of the piston (60).

The second auxiliary drive chamber (232) is defined by the front seal (290*b*), the front cylinder (40*c*), the piston's front waist (71*b*) and the second auxiliary drive surface (62*c*) of the piston (60).

The main lifting chamber (240) is defined by the drill bit (90), the drill bit guide (150), the lower cylinder (40*c*), the control tube (170) and the main lifting surface (63*c*) of the piston (60).

The first auxiliary lifting chamber (241) of the hammer is defined by the front seal (290*b*), the middle cylinder (40*b*), the piston's front waist (71*b*) and the first auxiliary lifting surface (63*b*) of the piston (60).

The second auxiliary lifting chamber (242) is defined by the rear seal (290*a*), the rear cylinder (40*a*), the piston's rear waist (71*a*) and the second auxiliary lifting surface (63*a*) of the piston (60).

The volumes of the drive chambers (230, 231, 232) and the lifting chambers (240, 241, 242) are variable depending on the piston's position.

The reverse circulation DTH hammer according to the invention as shown in FIGS. 1 to 3 has a set of end discharge ports (3) bored through the outer casing (1), preferably adjacent to the rear end portion of the discharge chambers (2) and connected to longitudinal discharge channels (4) formed in the outer surface of the outer casing (1). The end discharge ports (3) and longitudinal discharge channels (4) are covered by a cylindrical outer sealing sleeve (190), the ports (3) and channels (4) having the function of conveying the flow of pressurized fluid from the discharge chambers (2) to the outside of the outer casing (1), along the sides of the outer casing (1), to the peripheral region of the front end of the drill bit (90).

Control of the State of the Lifting Chambers (240, 241, 242)

When in the hammer cycle the impact face (61) of the piston (60) is in contact with the impact face (95) of the drill bit (90) and the drill bit (90) is at the rearmost point of its stroke, i.e. the hammer is at impact position (see FIG. 1), the lifting chambers (240, 241, 242) are fluidly communicated with the internal chambers (70*a*, 70*b*, 70*c*). Specifically, the main lifting chamber (240) is fluidly communicated with the forwardmost internal chamber (70*c*) through a front feeding passageway (73*b*) formed in between the front portion of the piston (60) and the control tube (170), and the auxiliary lifting chambers (241, 242) are fluidly communicated with the internal chambers (70*a*, 70*b*, 70*c*) through the set of auxiliary lifting chamber feeding ports (72*c*, 72*a*). In this way, the pressurized fluid can flow from the internal chambers (70*a*, 70*b*, 70*c*) toward the lifting chambers (240, 241, 242) and begin the rearward movement of the piston (60).

This flow of pressurized fluid will stop when the piston (60) has traveled in the front end to rear end direction of its stroke until the point where the front supply edges (66) of the piston (60) reaches the front supply edges (173) of the control tube (170). As the movement of the piston (60) continues further in the front end to rear end direction of its stroke, a point will be reached where the front discharge edges (68) of the piston (60) matches the front limit of the set of discharge ports (41) of the cylinders (40*a*, 40*b*, 40*c*). As the movement of the piston (60) continues even further, the lifting chambers (240, 241, 242) of the hammer will become fluidly communicated with the discharge chambers (2) (see FIG. 2). In this way, the pressurized fluid contained inside the lifting chambers (240, 241, 242) will be discharged into the discharge chambers (2) and from these chambers (2) it is able to freely flow out of the outer casing (1), through the end discharge ports (3) of the same, from where it is directed to the peripheral region of the front end of the drill bit (90) through the longitudinal discharge channels (4) of the outer casing (1), and along the external surface thereof. These ports (3) and channels (4) are covered by the outer sealing sleeve (190).

Control of the State of the Drive Chambers (230, 231, 232)

When in the hammer cycle the impact face (61) of the piston (60) is in contact with the impact face (95) of the drill bit (90) and the drill bit (90) is at the rearmost point of its stroke, i.e. the hammer is at impact position (see FIG. 1), the drive chambers (230, 231, 232) are in direct fluid communication with the discharge chambers (2) through the set of discharge ports (41) of the cylinders (40*a*, 40*b*, 40*c*). In this way the pressurized fluid contained inside the drive chambers (230, 231, 232) is able to freely flow to the discharge chambers (2) and from the discharge chambers (2) out of the outer casing (1) through the end discharge ports (3) of the same. After exiting the outer casing (1), the pressurized fluid is then directed to the peripheral region of the front end of the drill bit (90) through the longitudinal discharge channels (4) of the outer casing (1), and along the external surface thereof. These ports (3) and channels (4) are covered by the outer sealing sleeve (190).

The flow of pressurized fluid out of the drive chambers (230, 231, 232) will stop when the piston (60) has traveled in the front end to rear end direction of its stroke until the rear discharge edges (69) of the piston (60) reaches the rear limit of the set of discharge ports (41) of the cylinders (40). As the movement of the piston (60) continues further in the front end to rear end direction of its stroke, a point will be reached where the rear supply edges (67) of the piston (60) match the rear supply edges (174) of the control tube (170). As the movement of the piston (60) continues even further, the drive chambers (230, 231, 232) of the hammer become fluidly communicated with the internal chambers (70*a*, 70*b*, 70*c*) of the piston (60). Specifically, the main drive chamber becomes fluidly communicated with the rearmost internal chamber (70*a*) through the rear feeding passageway (73*a*) formed in between the rear portion of the piston (60) and the control tube (170) (see FIG. 2), while the auxiliary drive chambers (231, 232) becomes fluidly communicated with the internal chambers (70*a*, 70*b*, 70*c*) through the set of drive chamber feeding ports (72*b*, 72*d*). In this way, the drive chambers (230, 231, 232) will be filled with pressurized fluid coming from the internal chambers (70*a*, 70*b*, 70*c*).

Flushing Mode Operation

In the flushing mode of the hammer, i.e. when the bit (90) is not in contact with the rock, the percussion of the hammer stops, the impact face (61) of the piston (60) rests on the impact face (95) of the drill bit (90) and the pressurized fluid is conveyed directly to the peripheral region of the front end of the drill bit (90) along the following pathway: from the source of pressurized fluid to the set of inlet ports (177) of the control tube (170), through the passageway (176) formed in between the outer surface of the sample tube (130) and the inner surface of the control tube (170), through the set of supply ports (175) of the control tube (170), into the drive chambers (230, 231, 232), through the set of discharge ports (41) of the cylinders (40*a*, 40*b*, 40*c*), into the discharge chambers (2) and finally, from the discharge chambers (2) the pressurized fluid is able to flow freely to the outside of the outer casing (1) through the end discharge ports (3) of the same, from where it is directed to the peripheral region of the front end of the drill bit (90) through the longitudinal discharge channels (4) of the outer casing (1) and along the external surface thereof. These ports (3) and channels (4) are covered by the outer sealing sleeve (190).

DETAILED DESCRIPTION OF A SECOND PREFERRED EMBODIMENT OF THE INVENTION (FIG. 4)

Referring to FIG. 4, the pressurized fluid flow system according to the second preferred embodiment of the invention pertains in this case to a normal circulation drill hammer and it is substantially the same, with regards to the different modes and states of the lifting (240, 241, 242) and drive chambers (230, 231, 232) and control of the state of these chambers, as that of the reverse circulation drill hammer of FIGS. 1 to 3, save for the geometry of the passageway inside the control tube (170), which in this case is not delimited by a sample tube (130) as is in the reverse circulation drill hammer.

The normal circulation drill hammer of FIG. 4 is therefore characterized by comprising a normal circulation bit (90) having splines (97) on the outer surface thereof and channels (98) formed between the splines (97), wherein the channels (98) are covered by the driver sub (110), the bit (90) further having flushing holes (93) for connecting these channels (98) with the bottom of the hole.

As shown, the normal circulation drill hammer of the invention further comprises a drill bit guide (150) with one or more apertures (151) that connect the discharge chambers (2) with the channels (98) formed between the splines (97) of the drill bit (90).

From the discharge chambers (2), the pressurized fluid is conveyed to the bottom of the hole along the following pathway: through the apertures (151) in the drill bit guide (150), into the channels (98) between the splines (97) of the drill bit (90) and finally through the flushing holes (93) to the bottom of the hole.

In the embodiment depicted in FIG. 4, the bit (90) has a blind bore (91) and the control tube (170) extends into said blind bore (91), whereby the blind bore (91) serves as the pressurized fluid sealing means at the forward end of the control tube (170). However, in the absence of said blind bore (91), the pressurized fluid sealing means at the forward end of the control tube (170) may comprise a closed end of the control tube (170) itself.

The invention claimed is:

1. A pressurized fluid flow system for a down the hole drill hammer, wherein the hammer has a cylindrical outer casing, a rear sub affixed to the rear end of the outer casing for connecting the hammer to a source of pressurized fluid, a centrally-bored piston slidably and coaxially disposed for reciprocating movement inside the outer casing, and a drill bit slidably mounted on a driver sub in the front end of the hammer, the pressurized fluid flow system comprising:

a main lifting chamber and a main drive chamber located at opposite ends of the piston for causing the reciprocating movement of the piston due to the changes in pressure of the pressurized fluid contained therein;

a set of cylinders arranged longitudinally in series and coaxially disposed in between the outer casing and the piston, wherein the cylinders are supported on the outer casing and separated from each other by seals;

a set of auxiliary lifting chambers and auxiliary drive chambers for likewise causing, in conjunction with the main lifting chamber and the main drive chamber, the reciprocating movement of the piston due to the changes in pressure of the pressurized fluid contained therein, wherein the auxiliary lifting and drive chambers are respectively located at each side of said seals and are formed by respective waists machined around the piston;

a control tube coaxially arranged within the central bore of the piston, adjacent to the piston and affixed at its rear end to the rear sub;

a set of internal chambers including at least one rearmost internal chamber and one forwardmost internal chamber, wherein the internal chambers are defined by recesses in the inner surfaces of the piston, and wherein the internal chambers are disposed in permanent fluid communication with the source of pressurized fluid and filled with the same when the hammer is operative; and one or more discharge chambers formed in between the outer casing and the cylinders, wherein the discharge chambers are in permanent fluid communication with the bottom of the hole when the hammer is operative;

wherein the control tube has: pressurized fluid inlet ports bored at its rear end that connect with the source of pressurized fluid; a set of supply ports bored forward of said inlet ports and open to the internal chambers for allowing the pressurized fluid to flow from the source of pressurized fluid into the control tube and therefrom to the internal chambers; and pressurized fluid sealing means at the front end of the control tube to prevent pressurized fluid from flowing out of the control tube but through said supply ports;

wherein the piston comprises: a set of lifting chamber feeding ports, and a set of drive chamber feeding ports bored therethrough for respectively conveying pressurized fluid from the internal chambers to the auxiliary lifting chambers and to the auxiliary drive chambers;

wherein a front feeding passageway and a rear feeding passageway are respectively defined between the inner surfaces of the piston and recessed outer surfaces of the control tube at each end thereof, for respectively conveying pressurized fluid from the forwardmost internal chamber to the main lifting chamber and from the rearmost internal chamber to the main drive chamber; and wherein the cylinders have a set of discharge ports for discharging pressurized fluid from the lifting chambers and drive chambers to the discharge chambers.

2. A reverse circulation down the hole drill hammer comprising:

the pressurized fluid flow system of claim 1;

a sample tube coaxially disposed within the outer casing and extending from the rear sub to the drill bit, the control tube being coaxially arranged in between the piston and the sample tube with a gap with the sample tube that defines an annular passageway for the pressurized fluid to flow from the inlet ports of the control tube to the internal chambers, through the set of supply ports of the control tube; and one or more end discharge ports bored through the outer casing, the ports being in register with respective longitudinal discharge channels formed in the outer surface of the outer casing;

wherein both the end discharge ports and the longitudinal discharge channels of the outer casing are covered by an outer sealing sleeve for conveying the flow of pressurized fluid along the sides of the outer casing to the peripheral region of the front end of the drill bit.

3. The reverse circulation down the hole drill hammer of claim 2, wherein the bit has a central bore and the front end of the sample tube and control tube are inserted in said bore, and wherein the pressurized fluid sealing means at the forward end of the control tube comprise an internal shoulder in said bore of the bit.

4. The reverse circulation down the hole drill hammer of claim 2, wherein the pressurized fluid sealing means at the forward end of the control tube comprise a flange in the front end of the control tube.

5. A normal circulation down the hole drill hammer, wherein the hammer comprises:

the pressurized fluid flow system of claim 1, wherein the bit has splines on the outer surface thereof and channels formed between the splines, wherein the channels are covered by the driver sub and wherein the bit further has flushing holes for connecting the channels formed between the splines with the bottom of the hole; and a drill bit guide having one or more apertures that connect the discharge chambers with the channels formed between the splines of the drill bit.

6. The normal circulation down the hole drill hammer of claim 5, wherein the drill bit has a blind bore and the control tube extends into the blind bore, whereby the pressurized fluid sealing means at the forward end of the control tube comprise said blind bore.

7. The normal circulation down the hole drill hammer of claim 5, wherein the pressurized fluid sealing means at the forward end of the control tube comprise a closed end of the control tube.

* * * * *